US005200787A

United States Patent [19]

Nishiguchi

[11] Patent Number: 5,200,787

[45] Date of Patent: Apr. 6, 1993

[54] METHOD AND APPARATUS FOR SUPPLYING AND COLLECTING TONER IN AN IMAGE FORMING DEVICE

[75] Inventor: Keizo Nishiguchi, Osaka, Japan

[73] Assignee: Minolta Camera Kabushiki Kaisha, Osaka, Japan

[21] Appl. No.: 742,458

[22] Filed: Aug. 5, 1991

Related U.S. Application Data

[63] Continuation of Ser. No. 497,800, Mar. 21, 1990, abandoned, which is a continuation of Ser. No. 314,168, Feb. 22, 1989, abandoned.

[30] Foreign Application Priority Data

Feb. 23, 1988 [JP] Japan ..... 63-41587

[51] Int. Cl.[5] ..... G03G 21/00

[52] U.S. Cl. ..... 355/298

[58] Field of Search ..... 355/245, 246, 260, 298; 118/652; 222/DIG. 1; 430/125

[56] References Cited

U.S. PATENT DOCUMENTS

| | | | |
|---|---|---|---|
| 3,700,328 | 10/1972 | Davidge et al. | 355/298 |
| 4,218,126 | 8/1980 | Takeichi | 355/298 |
| 4,252,434 | 2/1981 | Nakamura et al. | 355/298 X |
| 4,360,944 | 11/1982 | Iwai et al. | 355/298 X |
| 4,724,459 | 2/1988 | Ford | 118/652 X |

FOREIGN PATENT DOCUMENTS

| | | | |
|---|---|---|---|
| 50-17231 | 2/1975 | Japan . | |
| 54-30832 | 3/1979 | Japan | 355/298 |
| 57-64280 | 4/1982 | Japan | 355/298 |
| 57-161769 | 10/1982 | Japan | 355/298 |
| 58-184983 | 10/1983 | Japan | 355/298 |
| 59-147375 | 8/1984 | Japan | 355/298 |
| 59-148080 | 8/1984 | Japan | 355/298 |
| 60-41079 | 3/1985 | Japan | 355/298 |
| 60-179773 | 9/1985 | Japan | 355/298 |
| 61-190570 | 11/1986 | Japan . | |
| 62-32483 | 2/1987 | Japan | 355/298 |
| 62-115483 | 5/1987 | Japan | 355/245 |

*Primary Examiner*—Fred L. Braun

*Attorney, Agent, or Firm*—Willian Brinks Olds Hofer Gilson & Lione

[57] ABSTRACT

An image forming apparatus having a device for supplying toner to a developing unit and for collecting the unused portion of the toner for treatment. The apparatus has a photosensitive member, an image forming member for forming an electrostatic latent image on the surface of the photosensitive member, a developing member for developing the electrostatic latent image with toner, a toner accommodating member containing unused toner and connected with the developing member through a first toner transport channel, a first transport member for transporting the unused toner to the developing member through the first toner transport channel, a cleaning member for removing residual toner remaining on the photosensitive member, a toner collecting member for collecting the removed residual toner, a second toner transport channel leading from the cleaning member to the toner collecting member for collecting removed toner therein and further downstream to the first toner transport channel, and a second transport member for transporting the removed toner to the toner collecting member and to the first toner transport channel when the toner collecting member is substantially filled with removed toner.

14 Claims, 6 Drawing Sheets

METHOD AND APPARATUS FOR SUPPLYING AND COLLECTING TONER IN AN IMAGE FORMING DEVICE

This application is a continuation of U.S. application Ser. No. 07/497,800, filed Mar. 21, 1990, now abandoned, which in turn is a continuation of U.S. application Ser. No. 07/314,168, filed Feb. 22, 1989, now abandoned.

BACKGROUND OF THE INVENTION

1. Field of the Invention

The present invention relates to image forming apparatus, and more particularly to a device for use in such apparatus for supplying toner to a developing unit and collecting the unused portion of the toner to treat the collected toner.

2. Description of the Related Art

With copying machines serving as image forming apparatus, the toner image on a photosensitive drum is transferred to copy paper, with an untransferred portion of toner remaining on the drum. Since the residual toner adversely affects the subsequent copying cycle, the toner remaining on the drum is removed therefrom and collected every copying cycle usually by a cleaning blade disposed in the vicinity of the drum.

The toner thus collected is treated by one of the following two methods.

(1) Full Recycling Method

The method wherein the collected toner transported through a channel is led into a toner supply channel for transporting fresh toner from a toner bottle to the developing unit and is thereby admixed with the fresh toner for reuse in copying.

(2) Disposal Method

The method wherein the collected toner is transported through a channel into a toner box for disposal.

However, the collected toner contains a large proportion with impaired electrostatic characteristics due to the presence of paper particles and the like and accordingly has the problem of being liable to produce fogged copy images and consequently give images of lower quality. Especially, the fogging of images becomes pronounced with an increase in the number of prints obtained with use of the collected toner.

On the other hand, when the disposal method is resorted to wherein the toner once used is collected and discarded to use fresh toner for development at all times, copy images can be produced free from the fog that would result from the use of the collected toner, whereas the time interval, i.e. period, at which the collection toner box is changed poses problems. Usually the period of change of the collection box (or a unit including the collection box) is determined based on the number of copies obtained at a predetermined B/W ratio (black/white ratio). The period thus determined is the same as the period of change of components (such as the photosensitive drum) other than the unit including the collection box. Nevertheless, if copies are made at a B/W ratio higher than the predetermined B/W ratio, the collection box becomes full before the specified period (see FIG. 9). Since the operator considers that the collection box is to be changed at the usual period, it is then likely that the copying machine will be used continually with the filled-up collection box. Consequently, there arises the problem that the collected toner transport channel becomes clogged up or that the toner transport spring provided inside the channel is heavily burdened and becomes broken.

To solve these problems, it appears useful to install means for detecting whether the collection box is full, but if the detecting means indicates that the box is filled up during a continuous operation to make a multiplicity of copies, the operator is obliged to interrupt the operation, hence inconvenience.

SUMMARY OF THE INVENTION

The main object of the present invention is to provide an image forming apparatus which is free of the likelihood that the collected toner transport channel therein will be clogged up with toner or the toner transport spring disposed inside the channel will be broken.

Another object of the invention is to provide an image forming apparatus which is continuously operable without any interruption for making a multiplicity of copies even if an indication that the toner collection box therein is full is given during the operation.

These object of the invention can be fulfilled by an image forming apparatus having a photosensitive member, an image forming means for forming an electrostatic latent image on the surface of said photosensitive member, a developing means for developing the electrostatic latent image formed on the photosensitive member with toner, a toner accommodating means containing unused toner and connected with said developing means through a first toner transport channel, a first transport means for transporting the unused toner to the developing means through said first toner transport channel, a cleaning means for removing residual toner remaining on the photosensitive member, a toner collecting means for collecting the residual toner removed by said cleaning means, a second toner transport channel leading from said cleaning means to said toner collecting means for collecting removed toner therein and further downstream to said first toner transport channel, and a second transport means for transporting the removed toner to said toner collecting means as well as to said first toner transport channel when the toner collecting means is substantially filled with removed toner.

The above and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

A first embodiment of the invention will be described below with reference to FIGS. 1 to 4.

Figure 3:
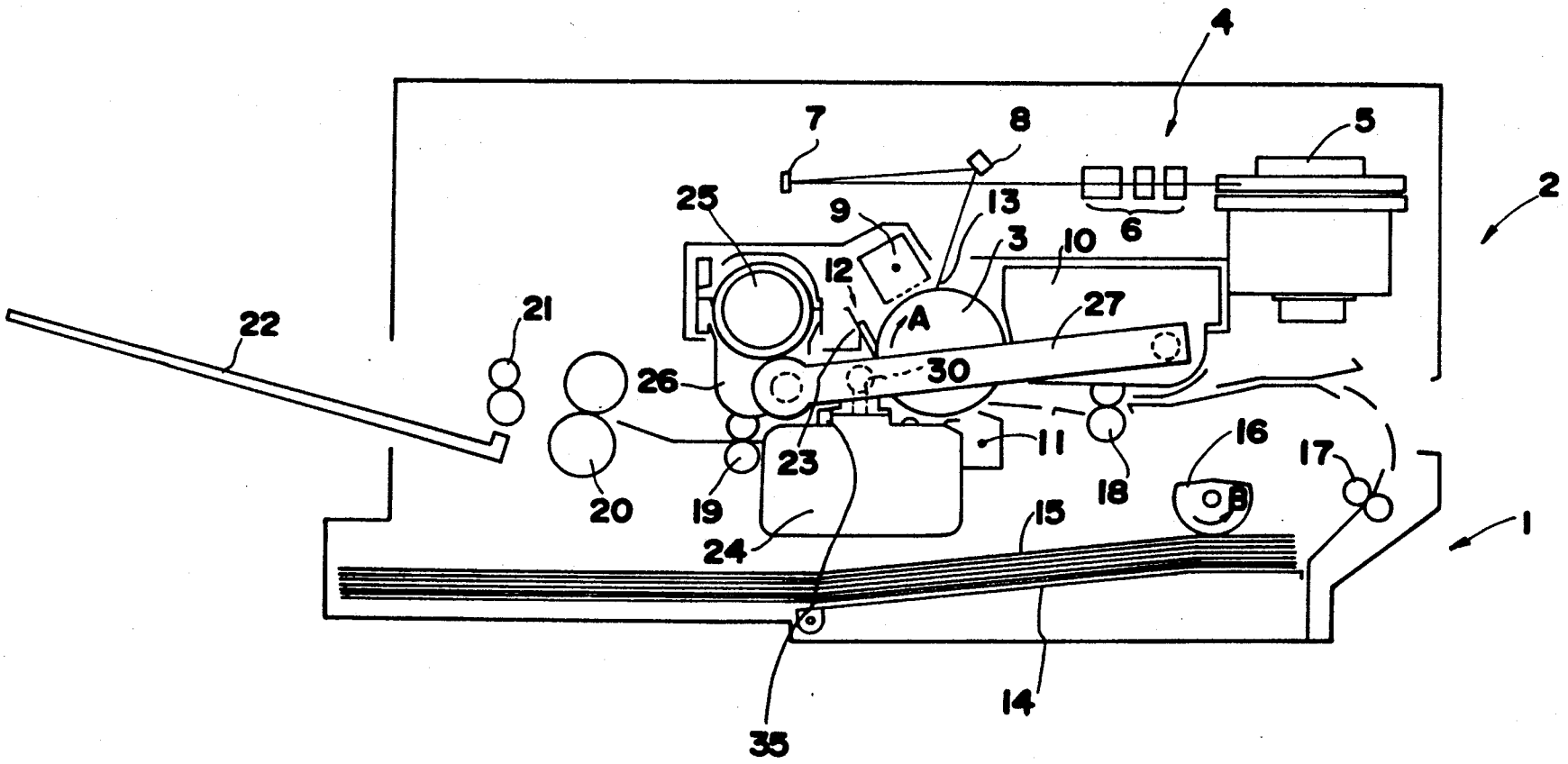
FIG. 3 is a diagram showing the interior construction of an image forming apparatus embodying the invention.
Figure 4:
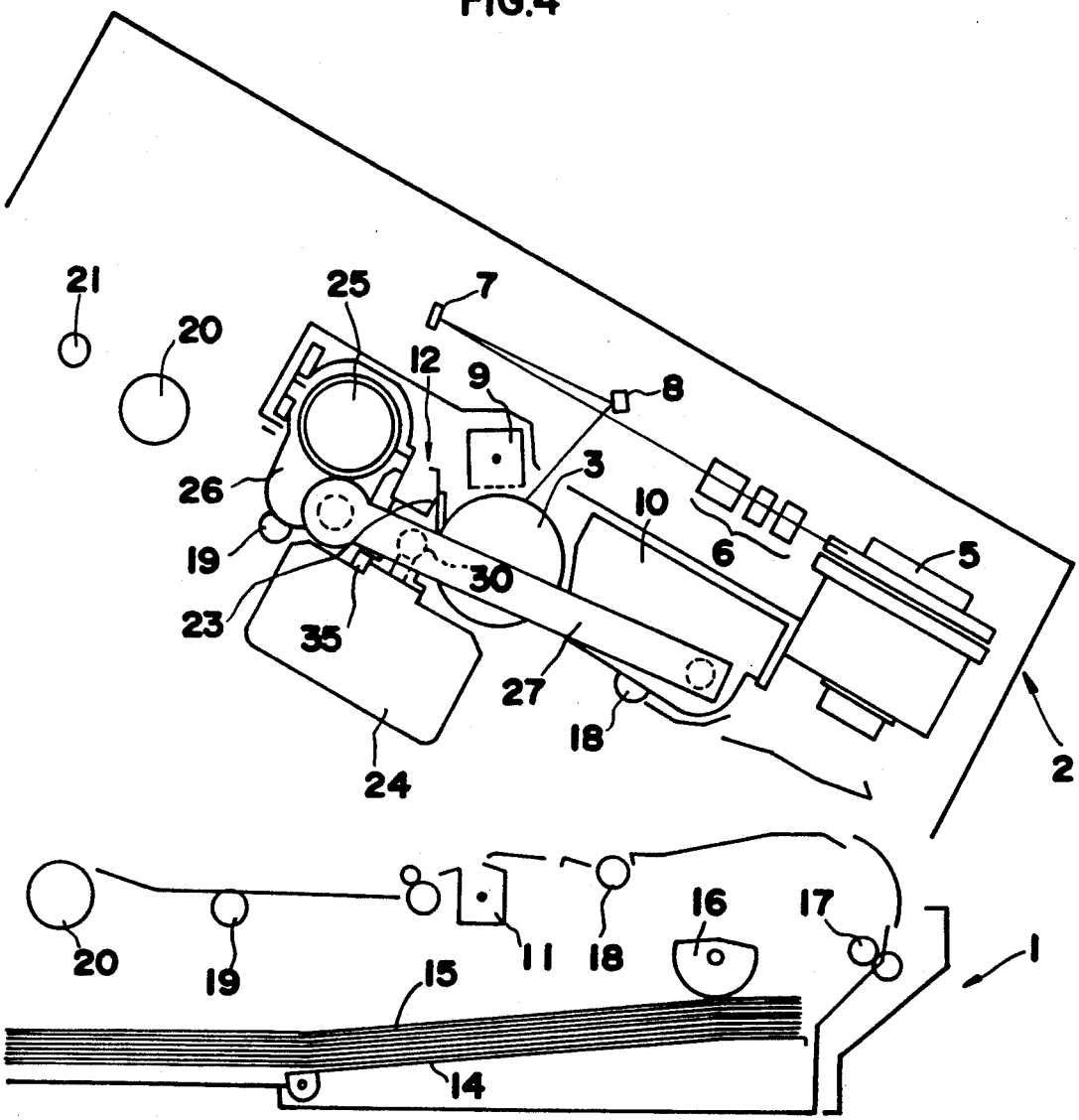
FIG. 4 is a diagram showing the apparatus of FIG. 3 with its upper portion opened upward.

FIG. 3 is a diagram schematically showing the interior construction of a printer as an image forming apparatus embodying the invention. The printer, which is of the clamshell type, comprises a recording paper transport assembly 1, and an image forming assembly 2 including a photosensitive drum 3, etc. and separated from the assembly 1. As seen in FIG. 4, the image forming assembly 2 is openable relative to the paper transport assembly 1.

A laser optical system 4 is disposed in the upper portion of the printer inside its frame. The laser optical system 4 includes a polygonal mirror 5, an image forming correction lens 6 and reflecting mirrors 7, 8. In accordance with image signals, a semiconductor laser (not shown) is driven to emit a laser beam, which is reflected from the polygonal mirror 5 rotating for scanning. Via the reflecting mirrors 7, 8, the reflected beam is projected onto the drum 3 for exposure. Arranged around the drum 3 are a sensitizing charger 9, developing unit 10, transfer charger 11 and cleaner 12.

The photosensitive drum 3 is drivingly rotated in the direction of arrow A shown. The drum 3 has its surface charged by the sensitizing charger 9 before the exposure and then exposed to the beam, whereby an electrostatic latent image corresponding to the image data given is formed on the drum surface at an exposure station 13. The latent image is developed into a visible toner image by the deposition of toner supplied from the developing unit 10. On the other hand, recording paper 15 on a paper cassette 14 is sent out by the rotation of a feed roller 16 in the direction of arrow B and fed to a timing roller 18 via a transport roller 17. The timing roller 18 is driven in synchronism with the rotation of the drum 3 to transport the paper 15 to the image forming assembly 2. The toner image is transferred onto the transported paper 15 by the transfer charger 11 which is opposed to the drum 3. The paper 15 bearing the transferred image is separated from the drum 3 and sent over a transport roller 19 to a fixing roller 20, by which the toner image is fixed to the paper with application of heat and pressure. The paper 15 is then delivered onto a paper tray 22 by a discharge roller 21. On the other hand, the residual toner remaining on the drum 3 is scraped off by a cleaning blade 23 of the cleaner 12 and accommodated in a toner collection bottle 24.

At the left side of the cleaning blade 23 shown in FIG. 3, a toner bottle 25 is disposed. Fresh toner contained in the bottle 25 is delivered through a toner hopper 26 and then through a first toner transport channel 27 to the developing unit 10. The developing unit 10 has a screw roller, sleeve roller, etc.

Figure 1:
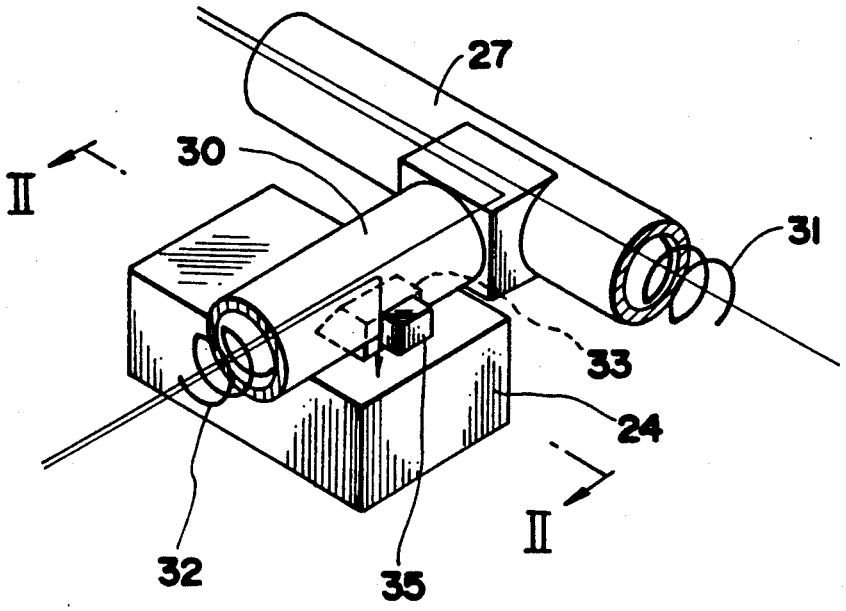
FIG. 1 is a fragmentary perspective view showing a first embodiment of the invention.
Figure 2:
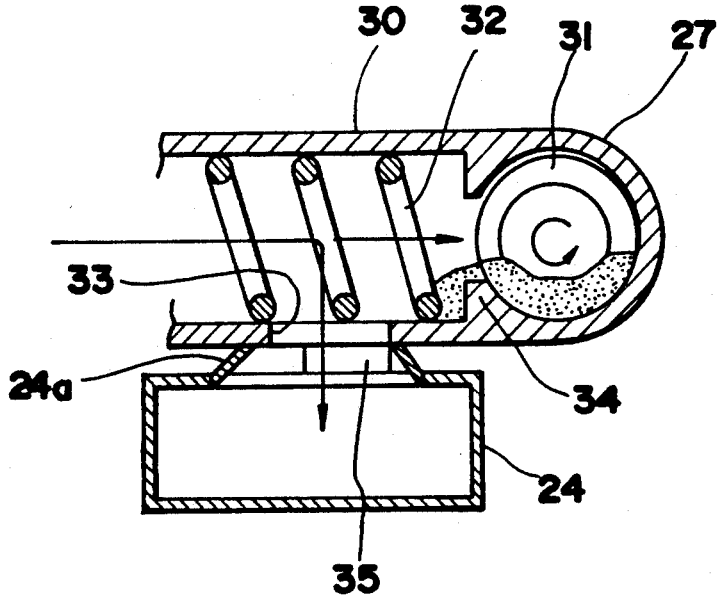
FIG. 2 is a view in section taken along the line II—II in FIG. 1.

With reference to FIGS. 1 and 2, the first toner transport channel 27 is in the form of a hollow cylinder and internally provided with a first spring 31 for transporting the fresh toner. A second toner transport channel 30 in the form of a hollow cylinder for transporting the collected toner therethrough is positioned between the drum 3 and the toner hopper 26 and communicates at its one end with the first toner transport channel 27. The second transport channel 30 has a rectangular opening 33 formed in its lower side, closer to the above end on the downstream side with respect to the direction of transport of the collected toner, and having a width larger than the width over which the toner is transported. The second transport channel 30 is connected at the other end thereof to the cleaner 12 and provided with a second spring 32 in its interior. The second spring 32, when rotated, transports the collected toner within the channel 30 to the collection bottle 24 or to the first transport channel 27. The toner collection bottle 24 has a mouth portion 24*a* opposed to the opening 33. The mouth portion 24*a* is tapered toward the opening 33 so as to prevent the collected toner from adhering to the side wall of this portion.

At the position where the collection bottle 24 is in contact with the channel wall at one side of the opening 33, a sensor 35 is provided for detecting the collected toner filling up the bottle 24 by emitting light into the opening 33. The light reflected from the interior when the bottle 24 is filled up with the collected toner to the opening 33 (filled-up state) differs in intensity from the light reflected when the toner is collected to below the opening 33. The sensor 35 detects the filled-up state from this difference.

With the device described above, the toner remaining on the photosensitive drum 3 is transported, collected and reused in the following manner.

First, the toner is scraped off the drum 3 by the cleaning blade 23 of the cleaner 12 and then transported through the second transport channel 30 by the rotation of the second spring 32. Subsequently, the collected toner falls into the collection bottle 24 through the opening 33 of the channel 30. Accordingly, the collected toner accumulates in the bottle 24 as the number of prints produced increases. When the bottle 24 has been filled up with the collected toner, any additional portion of collected toner no longer falls into the bottle 24, so that the collected toner is further transported toward the first toner transport channel 27. The collected toner is then forced into the first transport channel 27 by the spring 32, admixed with the fresh toner and transported to the developing unit 10.

Figure 5:
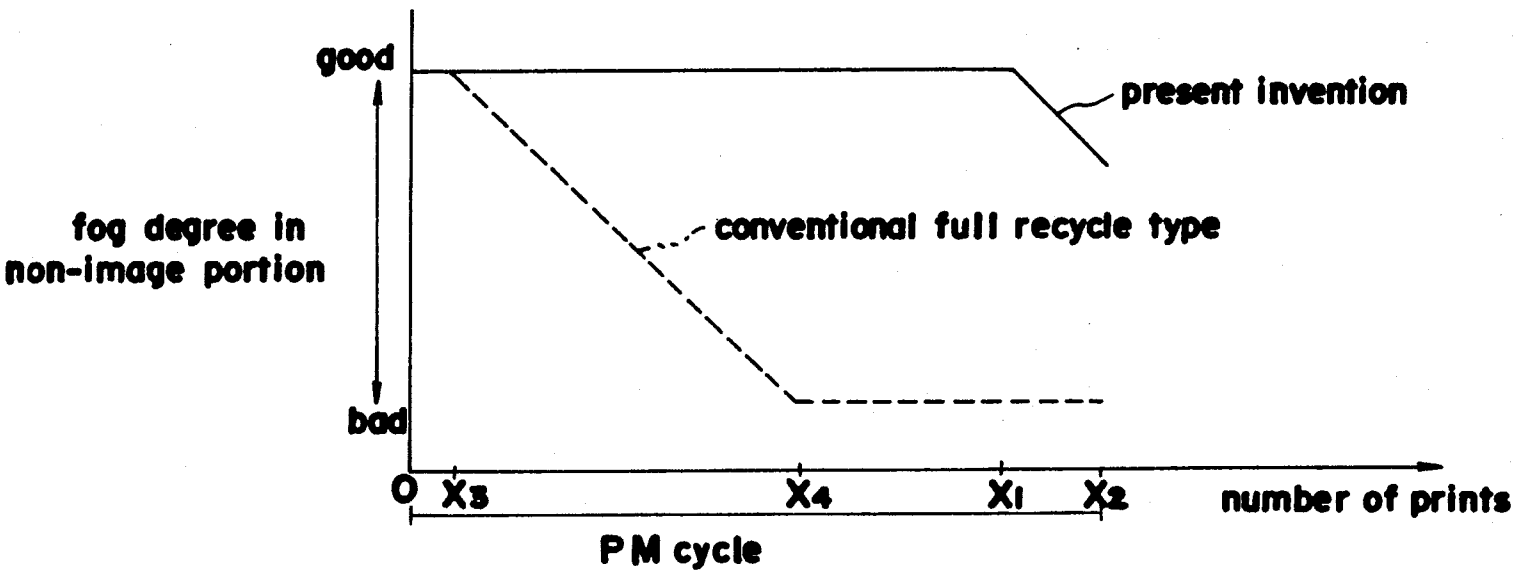
FIG. 5 is a graph showing the relationship between the number of prints and the degree of fogging, as established by the image forming apparatus of the invention and a conventional image forming apparatus of the full recycling type.

During the above operation, the copy images obtained were checked for the degree of fogging with the result shown in FIG. 5.

With the image forming apparatus of the invention, the collected toner accumulates in the bottle 24, and the fresh toner only is transported to the developing unit 10 until the number of prints increases to X1 (until the bottle 24 is filled up with the collected toner), so that no degradation of copy images occurs owing to the collected toner as seen in FIG. 5. After the number of prints exceeds X1, a number of prints are produced with the collected toner transported to the first transport channel 27. When the number of prints reaches X2, the specified period expires for a change of the bottle. Accordingly, no marked degradation occurs in the prints between the numbers X1 and X2 since the proportion of the collected toner admixed with the fresh toner is small. For making prints exceeding the number X2, the unit including the collection bottle is replaced by a new one to repeat the same cycle as above.

With the image forming apparatus of the invention, therefore, the toner collecting device can be prevented from breaking without entailing the degradation of copy images.

In the case of the conventional image forming apparatus wherein the collected toner is fully recycled, the degree of fogging of copy images increases after the number of prints exceeds X3 (to start transport of the collected toner from the collected toner transport channel to the fresh toner supply channel) until the number increases to X4. The prints thereafter obtained are seriously fogged and have very low qualitites.

Figure 6:
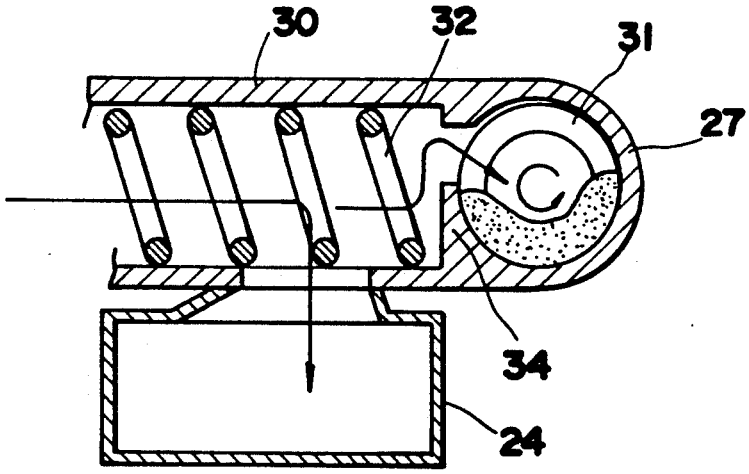
FIG. 6 is a fragmentary sectional view showing a second embodiment.

FIG. 6 is a fragmentary view showing a second embodiment of the invention.

As seen in FIG. 6, the second embodiment has a barrier 34 at the junction between the first toner transport channel 27 and the second toner transport channel 30. The barrier 34 extends upward from the bottom of the junction toward the center of the channel 30 to a level higher than the level of the fresh toner to be transported through the first transport channel 27.

The second embodiment has the same construction as the first with the exception of the barrier 34.

The second embodiment thus constructed has the same advantages as the first embodiment, while the toner in the first channel 27 can be prevented from spilling therefrom into the second channel 30.

Figure 7:
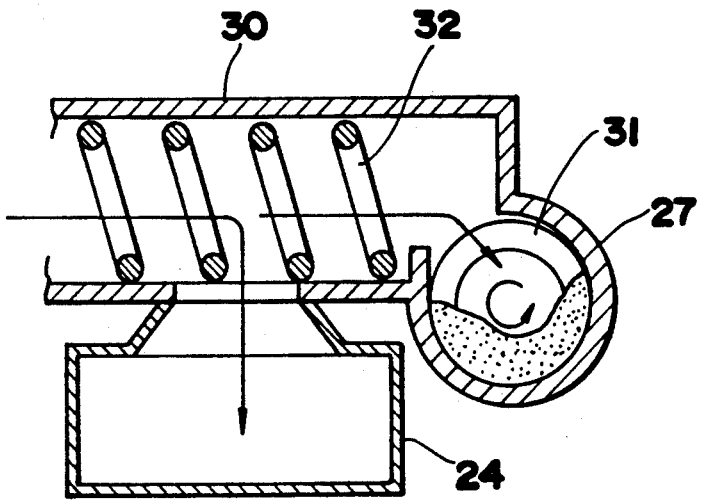
FIG. 7 is a fragmentary sectional view showing a third embodiment.

FIG. 7 is a fragmentary view showing a third embodiment.

With reference to FIG. 7, the third embodiment has the same construction as the first except that the center of the first toner transport channel 27 is positioned below the center of the second toner transport channel 30.

The third embodiment thus constructed has the same advantages as the second.

Figure 8:
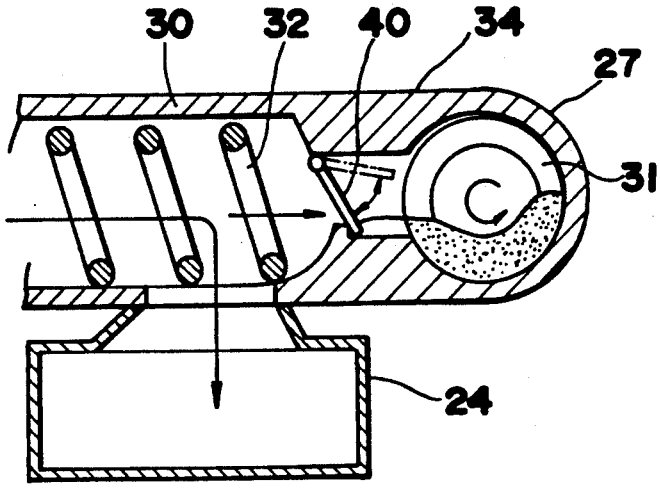
FIG. 8 is a fragmentary sectional view showing a fourth embodiment.
Figure 9:
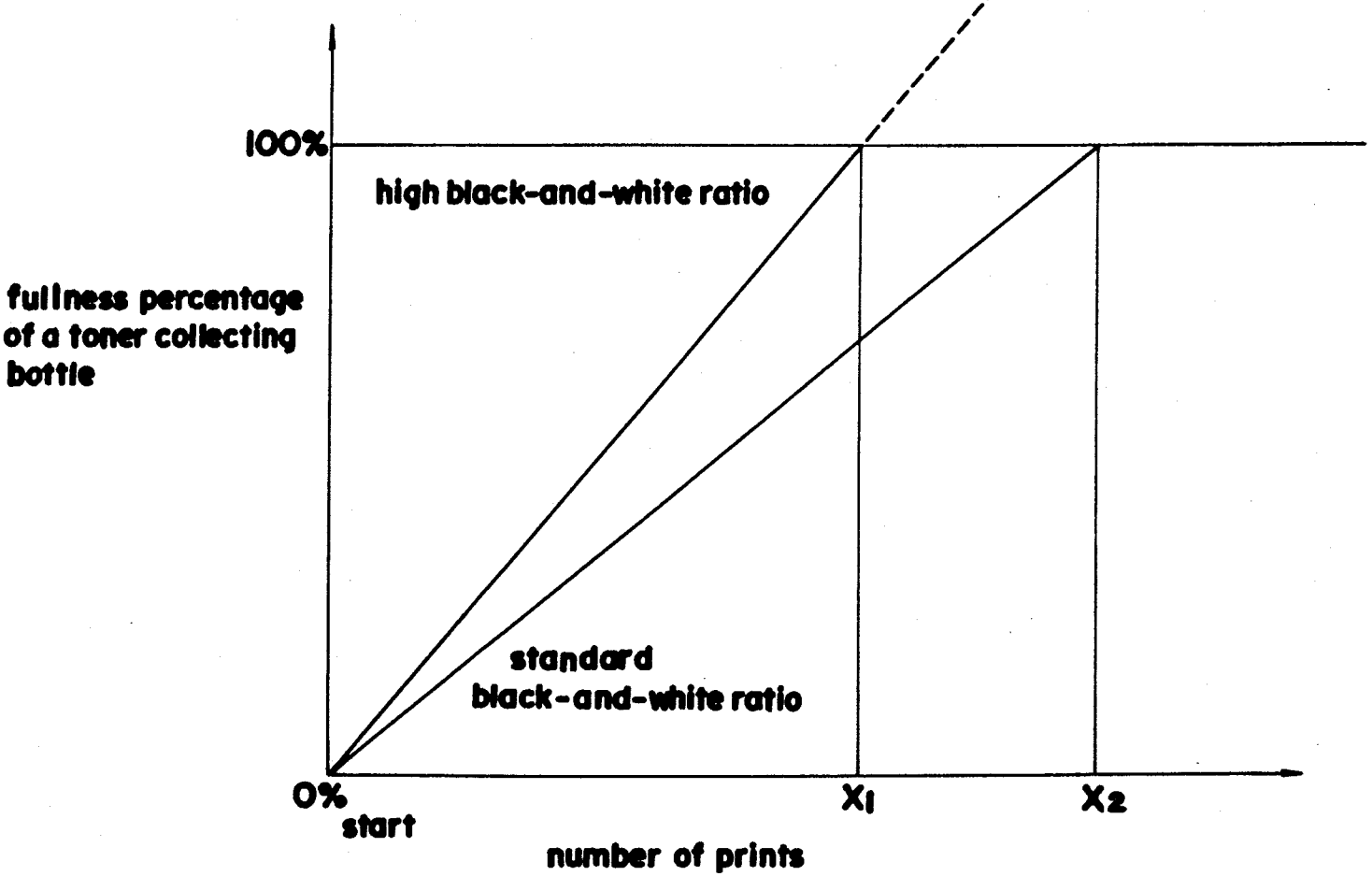
FIG. 9 is a graph showing the relationship between the collection bottle filling ratio and the number of prints, as established by a conventional copying machine.

FIG. 8 is a fragmentary view showing a fourth embodiment of the invention.

As shown in FIG. 8, the fourth embodiment has the same construction as the first except that a shutoff valve 40 is provided at the junction between the first toner transport channel 27 and the second toner transport channel 30. The valve 40, although usually held closed by the pressure of fresh toner, is opened by the pressure of collected toner forwarded by the second spring 32 after the toner collection bottle 24 has been filled up.

The above construction has the same advantages as the third embodiment and further completely prevents the fresh toner from spilling from the first channel 27 into the second channel 30.

It is to be noted here that the cleaner 12, the photosensitive drum 3, and the toner collection bottle 24 may be unified in one unit.

According to the present invention described above, the collected toner is transported from the second toner transport channel to the first toner transport channel when the toner collection bottle has been filled up. This prevents the collected toner from remaining in the second channel, consequently precluding the second transport means in the second channel from breaking.

Additionally, since none of the collected toner is transported to the first transport channel before the toner collection bottle is filled up, copy images can be obtained with a stabilized quality free from any aggravated fog.

Further even if the operator is notified that the collection bottle is full during a continuous operation to make a multiplicity of copies, the contemplated copying operation can be completed without any interruption.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus which comprises:
image forming means for forming an electrostatic latent image on a photosensitive member;
developing means accommodating a toner for developing said electrostatic latent image;
cleaning means for removing the toner remaining on the photosensitive member;
collecting means for collecting the toner removed by said cleaning means; and
transporting means for transporting the toner removed from the photosensitive member to the collecting means until the collecting means is substantially filled with the removed toner, and for thereafter transporting the toner removed from the photosensitive member to the developing means.

2. An image forming apparatus as claimed in claim 1 wherein said toner transported to the developing means is re-used for developing.

3. An image forming apparatus which comprises:
means for forming an electrostatic latent image on a photosensitive member;
means accommodating a toner for developing said electrostatic latent image;
means for cleaning the toner remaining on the photosensitive member;
a transport channel connecting said developing means and said cleaning means;
means provided in said transport channel for transporting the removed toner from the cleaning means to the developing means; and
a toner container connected to said transport channel between the cleaning means and the developing means for collecting the removed toner being transported from said cleaning means to said developing means by said transporting means and for preventing said removed toner from reaching said developing means until said toner container is substantially filed with the removed toner, after which the removed toner is transported to the developing means by the transporting means.

4. An image forming apparatus which comprises:
forming means for forming an electrostatic latent image on a photosensitive member;
developing means accommodating a toner for developing said electrostatic latent image;
cleaning means for removing the toner remaining on the photosensitive member;
transport channel means connecting said developing means with said cleaning means and with a supply of unused toner;
transporting means provided in said transport channel means for transporting the removed toner from the cleaning means to the developing means and for transporting unused toner from said unused toner supply to said developing means;

collecting means including a toner container for collecting the toner removed from the photosensitive member by the cleaning means; and a barrier member provided at a junction of the transport channel means and positioned at the downstream side of said toner container with respect to a removed toner transporting direction for preventing the unused toner in the transport channel means from overflowing into the toner container.

5. An image forming apparatus as claimed in claim 4 wherein said barrier member is an element projecting into the transport channel means.

6. An image forming apparatus which comprises:

means for forming an electrostatic latent image on a photosensitive member;

means accommodating a toner for developing said electrostatic latent image;

cleaning means for removing the toner remaining on the photosensitive member;

a transport channel connecting said developing means and said cleaning means;

means provided in said transport channel for transporting the removed toner from the cleaning means to the developing means; and a collection member connected to said transport channel between the cleaning means and the developing means for collecting the removed toner being transported from said cleaning means to said developing means by said transporting means within said transport channel and for preventing said removed toner from reaching said developing means until a predetermined amount of removed toner has been collected by said collection member, after which said removed toner is transported to the developing means by said transporting means.

7. An image forming apparatus as claimed in claim 6 wherein said toner transported from the cleaning means to the developing means is re-used for developing.

8. An image forming apparatus which comprises:

a photosensitive member;

an image forming means for forming an electrostatic latent image on the surface of said photosensitive member;

a developing means for developing the electrostatic latent image formed on the photosensitive member with toner;

a toner accommodating means containing unused toner and connected with said developing means through a first toner transport channel;

a first transport means for transporting the unused toner to the developing means through said first toner transport channel;

a cleaning means for removing residual toner remaining on the photosensitive member;

a toner collecting means for collecting the residual toner removed by said cleaning means;

a second toner transport channel leading from said cleaning means to said toner collecting means for collecting removed toner therein and further downstream to said first toner transport channel; and a second transport means for transporting the removed toner to said toner collecting means as well as to said first toner transport channel when the toner collecting means is substantially filled with removed toner.

9. An image forming apparatus which comprises:

a photosensitive member;

an image forming means for forming an electrostatic latent image on the surface of said photosensitive member;

a developing means for developing the electrostatic latent image formed on the photosensitive member with toner;

a cleaning means for removing residual toner remaining on the photosensitive member;

a toner accommodating means for accommodating therein unused toner and provided in the vicinity of said cleaning means;

a first toner transport channel leading from said toner accommodating means to said developing means;

a first transport means for transporting the unused toner to the developing means through said first toner transport channel;

a toner collecting means for collecting the residual toner removed by said cleaning means;

a second toner transport channel leading from said cleaning means to said toner collecting means for collecting removed toner therein and further downstream to said first toner transport channel so as to be connected therewith in substantially the same plane; and a second transport means for transporting the removed toner to said toner collecting means as well as to said first toner transport channel through a connecting portion formed by the connection of said first and second toner transport channels when the toner collecting means is substantially filled with removed toner.

10. An image forming apparatus as claimed in claim 9 wherein a member for preventing the unused toner transported through said first toner transport channel from entering into said second toner transport channel is provided at said connecting portion.

11. An image forming apparatus which comprises:

a photosensitive member;

an image forming means for forming an electrostatic latent image on the surface of said photosensitive member;

a developing means for developing the electrostatic latent image formed on the photosensitive member with toner;

a cleaning means for removing residual toner remaining on the photosensitive member;

a toner accommodating means including an unused toner accommodating bottle for containing the unused toner and connected with said developing means through a first toner transport channel;

a first transport means transporting the unused toner to the developing means through said first toner transport channel;

a cleaning means for removing residual toner remaining on the photosensitive member;

a toner collecting means including a residual toner collecting bottle which has a mouth portion for collecting the residual toner removed by said cleaning means;

a second toner transport channel provided with an opening portion on the lower side thereof and leading from said cleaning means to said toner collecting means for collecting removed toner therein in the condition that said opening portion is connected with said mouth portion of the unused toner collecting bottle and further downstream to said first toner transport channel so as to be connected therewith in substantially the same plane; and a second transport means for transporting the removed toner to said toner collecting means as well as to said first toner transport channel through a connecting portion formed by the connection of said first and second toner transport channels when the toner collecting means is substantially filled with removed toner.

12. An image forming apparatus as claimed in claim 11 wherein said first and second transport means comprise springs which push and transport the toner.

13. In an image forming apparatus comprising means for forming an electrostatic latent image on a photosensitive member and means accommodating a toner for developing said electrostatic latent image, a method comprising the steps of:

removing the toner remaining on the photosensitive member;

collecting the toner removed from the photosensitive member in collecting means until the collecting means is substantially filled with the removed toner; and thereafter transporting the removed toner to the developing means.

14. A method as claimed in claim 13 further comprising the step of:

re-using the removed toner for developing after the transportation to the developing means.

* * * * *

UNITED STATES PATENT AND TRADEMARK OFFICE

CERTIFICATE OF CORRECTION

PATENT NO. : 5,200,787

DATED : April 6, 1993

INVENTOR(S) : Keizo Nishiguchi

It is certified that error appears in the above-identified patent and that said Letters Patent is hereby corrected as shown below:

In col. 6, line 53, (claim 3, line 20), change "filed" to --filled--.

In col. 9, line 1, (claim 11, line 29), change "unused" to --residual--.

Signed and Sealed this

Eighth Day of February, 1994

Bruce Lehman

*Attest:*

BRUCE LEHMAN

*Attesting Officer*

*Commissioner of Patents and Trademarks*